US009821949B2

(12) United States Patent
Negus et al.

(10) Patent No.: US 9,821,949 B2
(45) Date of Patent: Nov. 21, 2017

(54) RUPTURABLE CONTAINER HAVING DIRECTIONAL BURST SEAL

(71) Applicant: BEMIS COMPANY, INC., Neenah, WI (US)

(72) Inventors: John F. Negus, Jefferson, WI (US); Alison J. Umbarger, DePere, WI (US); Kevin D. Glaser, Oshkosh, WI (US)

(73) Assignee: Bernis Company, Inc., Neenah, WI (US)

( * ) Notice: Subject to any disclaimer, the term of this patent is extended or adjusted under 35 U.S.C. 154(b) by 191 days.

(21) Appl. No.: 14/760,521

(22) PCT Filed: Jan. 28, 2013

(86) PCT No.: PCT/US2013/023392

§ 371 (c)(1),
(2) Date: Jul. 13, 2015

(87) PCT Pub. No.: WO2014/116246

PCT Pub. Date: Jul. 31, 2014

(65) Prior Publication Data

US 2015/0353273 A1 Dec. 10, 2015

(51) Int. Cl.
*B65D 77/20* (2006.01)
*B65D 85/804* (2006.01)

(52) U.S. Cl.
CPC ..... *B65D 85/8043* (2013.01); *B65D 77/2064* (2013.01)

(58) Field of Classification Search
CPC ..... B65D 85/8043; B65D 77/2064
USPC ..... 220/359.1–359.4; 215/232; 222/107, 222/206, 215; 206/484; 383/210
See application file for complete search history.

(56) References Cited

U.S. PATENT DOCUMENTS

| | | | | |
|---|---|---|---|---|
| 3,083,821 | A | 4/1963 | Woodson | |
| 3,601,252 | A * | 8/1971 | Sager | B29C 66/4312 215/370 |
| 4,537,308 | A | 8/1985 | Hollander, Jr. | |
| 4,605,142 | A | 8/1986 | Itoh et al. | |
| 4,759,472 | A | 7/1988 | Strenger | |
| 4,834,247 | A * | 5/1989 | Oshima | B65D 75/12 219/734 |
| 4,872,556 | A | 10/1989 | Farmer | |
| 4,938,390 | A * | 7/1990 | Markva | B65D 51/20 156/69 |
| 5,131,760 | A | 7/1992 | Farmer | |

(Continued)

FOREIGN PATENT DOCUMENTS

| | | |
|---|---|---|
| EP | 0078761 A2 | 5/1983 |
| EP | 0179641 A2 | 4/1986 |

(Continued)

*Primary Examiner* — James N Smalley
(74) *Attorney, Agent, or Firm* — Amy L. De Coster

(57) ABSTRACT

The present invention relates to rupturable containers comprising a planar flange and a lidding film secured to the flange, and comprising a self-rupturing continuous inner seal, a first and a second appendicle seal; wherein each of the appendicle seals is spaced apart from the inner seal and positioned between the inner seal and a peripheral edge of the container, and a discharge channel configured to regulate the direction of discharge of the contents of the container upon rupturing of the inner seal.

20 Claims, 3 Drawing Sheets

(56) References Cited

U.S. PATENT DOCUMENTS

| | | | | |
|---|---|---|---|---|
| 5,209,347 | A | 5/1993 | Fabisiewicz et al. | |
| 5,325,765 | A | 7/1994 | Sylvan et al. | |
| 5,482,175 | A * | 1/1996 | Arrar | B65D 17/503 220/203.08 |
| 5,840,189 | A | 11/1998 | Sylvan et al. | |
| 6,142,063 | A | 11/2000 | Beaulieu et al. | |
| 6,698,333 | B2 | 3/2004 | Halliday et al. | |
| 6,893,696 | B2 | 5/2005 | Hansen et al. | |
| 7,063,228 | B2 | 6/2006 | Mita et al. | |
| 7,318,372 | B2 | 1/2008 | Cooke | |
| 7,418,899 | B2 | 9/2008 | Halliday et al. | |
| 7,458,741 | B2 | 12/2008 | Detwiler et al. | |
| 7,556,191 | B2 | 7/2009 | Hewitt et al. | |
| 2004/0079763 | A1 | 4/2004 | Powell et al. | |
| 2010/0326283 | A1 | 12/2010 | Evers et al. | |
| 2012/0292340 | A1 * | 11/2012 | Nadon | B65D 75/5894 222/107 |

FOREIGN PATENT DOCUMENTS

| | | | |
|---|---|---|---|
| EP | 0272922 | A2 | 6/1988 |
| EP | 0468079 | A1 | 1/1992 |
| EP | 0512468 | A1 | 11/1992 |
| EP | 0821906 | A1 | 2/1998 |
| GB | 2188520 | A | 9/1987 |
| WO | 1994001344 | A1 | 1/1994 |
| WO | 9856686 | A1 | 12/1998 |
| WO | 2002019875 | A1 | 3/2002 |
| WO | 055771 | A1 | 7/2003 |
| WO | 2010102666 | A1 | 9/2010 |

* cited by examiner

RUPTURABLE CONTAINER HAVING DIRECTIONAL BURST SEAL

BACKGROUND OF THE INVENTION

The present invention relates to a sealed container having a pressure-rupturable seal. When pressure is applied from inside the container, the seal preferentially ruptures in a well-defined path through the seal to permit controlled directional flow of the contents from the container.

In recent years, the popularity of "single-serve" beverage machines has been increasing. In the single-serve beverage machine, a predetermined amount of a beverage making ingredient, such as a liquid or solid concentrate/extract, is held in a container or capsule, which is placed into a beverage making apparatus. The apparatus then introduces water by injection into the container, where it dissolves, extracts, emulsifies, or dilutes the ingredient(s) to form a flavored beverage. The flavored beverage must then exit the container e.g. by flowing through an opening or perforation in the container.

Known single-serve beverage making systems are described, for example, in U.S. Pat. No. 5,325,765 (Sylvan et al); U.S. Pat. No. 5,840,189 (Sylvan et al); U.S. Pat. No. 6,142,063 (Beaulieu et al); U.S. Pat. No. 7,318,372 (Cooke); U.S. Pat. No. 6,698,333 (Halliday et al): U.S. Pat. No. 7,418,899 (Halliday et al); and EP-A-0821906 (Sara Lee), EP-A-0512468 (Nestle), EP-A-0468079 (Nestle), WO 94/01344 (Nestle), EP-A-0272922 (Kenco), and EP-A-0179641 (Mars) and WO 02/19875 (Mars), the entire contents of all of which are hereby incorporated herein by reference.

Containers for single-serve beverage machines may be made by thermoforming sheet or injection molding monolayer or multilayer polymeric resins to form relatively rigid plastic containers or capsules having at least one recessed cavity. A container may have a single recessed cavity or be internally divided into a plurality of recessed cavities. A liquid beverage making ingredient, e.g., a flavored syrup concentrate is placed into the cavity, and the container is closed by sealing a lid comprising e.g. a laminate of metallic foil and heat sealable plastic over the cavity.

During beverage making, the container top or bottom is pierced by a tubular inlet. The inlet tube introduces pressurized water and/or gas into the container which infuses with the beverage ingredient(s). The resulting pressurized mixture must then exit the container by rupturing through the seal between the lid and container. The problem with such containers is that the seal must be torn open to dispense the contents, which is often difficult and which often results in uncontrolled flow of the contents.

The improvement provided by this invention is a self-rupturing seal n such containers that is easily ruptured at a desired location by the application of pressure to the seal. When pressure is applied from inside the container, the seal preferentially ruptures in a well-defined path through the seal to permit controlled directional flow of the contents from the container.

SUMMARY OF THE INVENTION

The present invention provides rupturable container comprising a rigid or semi-rigid planar flange and a lidding film secured to the flange, and comprising a self-rupturing continuous inner seal, a first and a second appendicle seal; wherein each of the appendicle seals is spaced apart from the inner seal and positioned between the inner seal and a peripheral edge of the container, and a discharge channel configured to regulate the direction of discharge of the contents of the container upon rupturing of the inner seal.

In one embodiment, the present invention provides a rupturable container comprising a rigid or semi-rigid planar flange and a lidding film secured to the flange, and a recessed cavity circumscribed by said flange and having at least a first side wall and an adjacent second side wall. The container further comprises a self-rupturing continuous inner seal, a first and a second appendicle seal; wherein each of the appendicle seals is spaced apart from the inner seal and positioned between the inner seal and a peripheral edge of the container, and a discharge channel configured to regulate the direction of discharge of the contents of the container upon rupturing of the inner seal. The first appendicle seal is positioned generally parallel to the inner seal on a plane perpendicular to the first side wall. The second appendicle seal is positioned generally parallel to the inner seal on a plane perpendicular to the second side wall such that the discharge channel is located between the ends of each of the appendicle seals.

In another embodiment, the present invention provides a rupturable container comprising a rigid or semi-rigid planar flange and a lidding film secured to the flange, and a recessed cavity circumscribed by said flange and having at least a first side wall and an adjacent second side wall. The container further comprises a self-rupturing continuous inner seal having a rupturing area, a first and a second appendicle seal: wherein each of the appendicle seals is spaced apart from the inner seal and positioned between the inner seal and a peripheral edge of the container, and a discharge channel is configured to regulate the direction of discharge of the contents of the container upon rupturing of the inner seal. The first appendicle seal is positioned generally parallel to the inner seal on a plane perpendicular to the first side wall. The second appendicle seal is positioned generally parallel to the inner seal on a plane perpendicular to the second side wall such that the rupturing area and the discharge channel is located between the ends of each of the appendicle seals.

In still another embodiment, the present invention provides a rupturable container comprising a rigid or semi-rigid planar flange and a lidding film secured to the flange, and a recessed cavity circumscribed by said flange and having at least a first side wall and an adjacent second side wall. The container further comprises a self-rupturing continuous inner seal having a rupturing area, a first and a second appendicle seal; wherein each of the appendicle seals is spaced apart from the inner seal and positioned between the inner seal and a peripheral edge of the container, and a discharge channel is configured to regulate the discharge of the contents of the container in a direction generally parallel to the flange upon rupturing of the inner seal and between the ends of each of the appendicle seals.

DETAILED DESCRIPTION OF THE INVENTION

Figure 1:
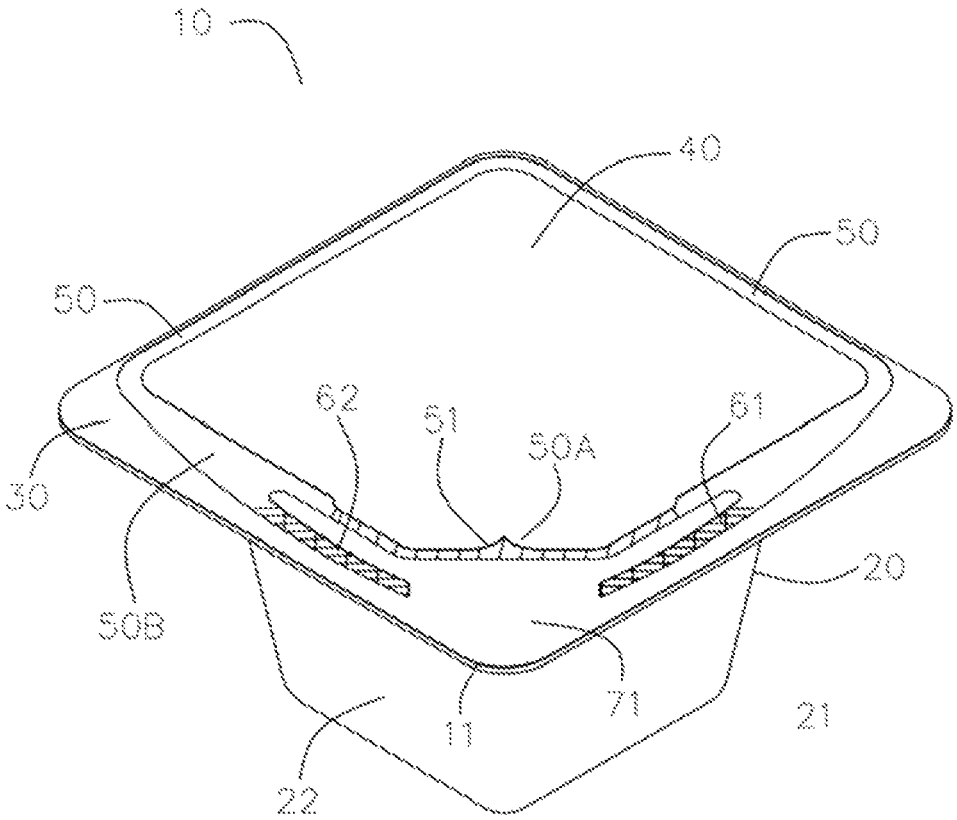
FIG. 1 depicts an isometric perspective view of one embodiment of the present invention.

Referring now more particularly to FIG. 1 of the drawings, there is shown an illustrative container 10 embodying the invention, comprising a recessed cavity 20, a rigid or semi-rigid planar flange 30 and a lidding film 40 secured to the flange. It will be appreciated that the choice of materials used to form container 10 is determined by the nature of the substance to be packaged in the container. For example, for packaging pre-sterilized and sterile products such as milk, dairy products, puddings, desserts, fruit, vegetable juices, soups, sauces and the like, container 10 must be capable of withstanding aseptic packaging process conditions. Aseptic packaging conditions are known in the art and may include subjecting the packaging materials to temperatures up to 100° C. or higher for short periods of time and/or exposure to liquid or vaporized hydrogen peroxide. Rupturable containers of the present invention may be used for aseptic packaging without exhibiting any deformation of shape and/or delamination of packaging materials. When containing a flavoring constituent for use in a single-serve beverage making machine, container 10 must be formed from materials inert to these flavoring ingredients. Preferably, container 10 is formed from packaging materials which include oxygen and/or water vapor barrier materials. Such packaging materials are described in further details herein.

As depicted in FIG. 1, rupturable container 10 has a self-rupturing continuous inner seal 50 which circumscribes recessed cavity 20. Continuous inner seal 50 is self-rupturing, meaning that liquid and/or gases can escape the container through the seal, preferably in a controlled manner, when a threshold pressure (e.g., from about 2.5 psig to about 15 psi, and preferably from about 2.5 psi to about 5 psi) is reached within the container. If container 10 is used in a single-serve beverage system, such a pressure is normally attained by pressured water when water is inserted into recessed cavity 20 during the beverage making process. In this embodiment, container 10 is shown having a first appendicle seal 61 and a second appendicle seal 62. Seals 50, 61 and 62 may be formed by heat sealing lidding film 40 to flange 30 under heat and positive pressure. Alternatively, seals 50, 61 and 62 may be formed by applying an appropriate adhesive between flange 30 and lidding film 40. Such adhesives are well known in the art. Container 10 further includes a discharge channel 71 which is configured to regulate the direction of discharge of the contents of the container during rupturing of inner seal 50. The discharge of the contents of the container upon pressurizing of recessed cavity 20 preferably occurs at a defined, self-rupturing area 50A of inner seal 50 having a particular construction (e.g., in terms of lidding film composition) and geometry (e.g., an inward protrusion) that can be varied to adjust the rupturing characteristics, including threshold pressure, as well as the direction and even the velocity of the escaping contents.

In this embodiment, recessed cavity 20 includes at least a first side wall 21 and an adjacent second side wall 22. Although the illustrated container 10 is shown having a total of four side walls, (e.g., 21, 22, 23 (not shown) and 24 (not shown)) container 10 may have any number of side walls as desired. It will be appreciated that the surface of adjacent side walls 21 and 22 may assist with controlling the direction of discharge of the contents of the container towards a predetermined location of the container (e.g., a rupturing area 50A of inner seal 50). Inner seal 50 is characterized as having self-rupturing seal area 50A and non-rupturing seal area 50B, having differing seal widths along a width dimension that is perpendicular to the edge of the container. A typical width of the inner seal is between about 0.1 centimeters and 0.5 centimeters (about 0.04 inches to about 0.2 inches). Self-rupturing seal area 50A is marked in FIGS. 1 and 2 with diagonal line segments. According to the embodiment of FIGS. 1 and 2, the self-rupturing seal area 50A forms an inward protrusion 51 relative to an adjacent portion of the inner seal 50. This protrusion therefore extends toward the interior, for example the center of the recessed cavity 20. Inward protrusion 51 may have any form which concentrates stress produced by internal pressure on the inner seal at a particular location along the inner seal thereby facilitating the rupturing of the seal. Inward protrusion 51 may include "V" shaped forms such as a chevron and the like.

Figure 2:
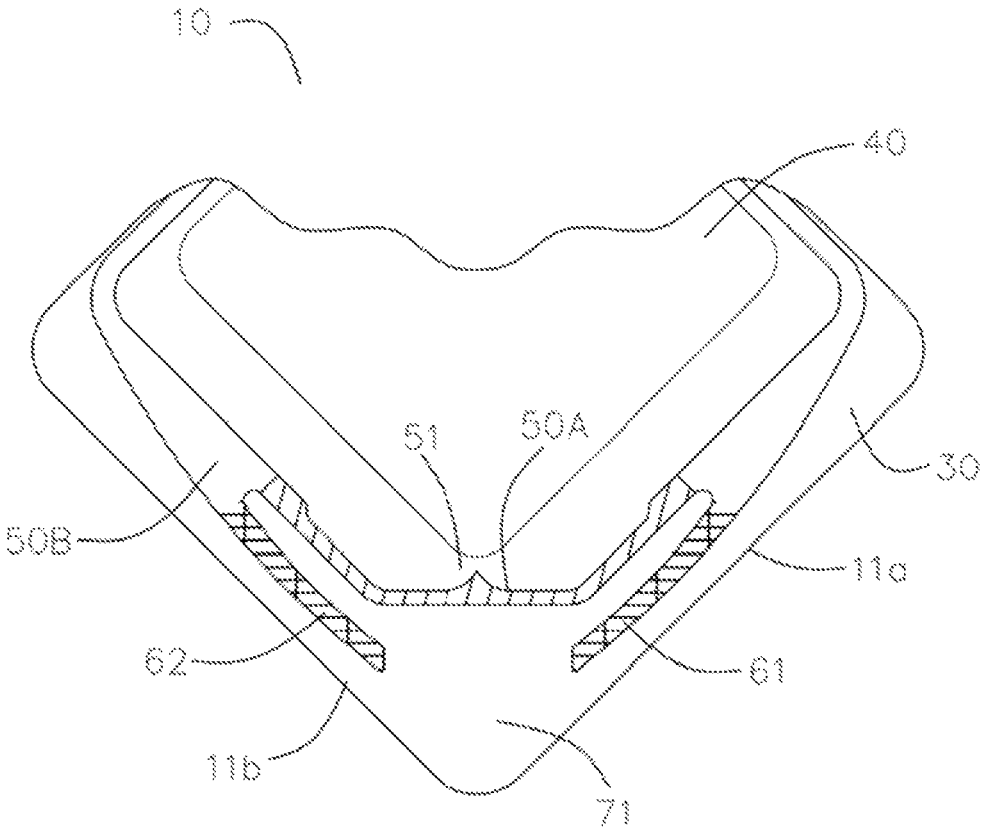
FIG. 2 depicts a close-up view of the embodiment of the present invention depicted in FIG. 1.

Controlling the direction of discharge once the self-rupturing area 50A has burst is provided by discharge channel 71 which is formed below the self-rupturing area 50A and between each end of appendicle seals 61 and 62. Without being bound by any particular theory of the invention, it is believed that the shape of each of the appendicle seals, 61 and 62 (e.g., in terms of width and length) and their respective location relative to inner seal 50 also affect the direction of discharge of the contents from container 10. In one embodiment, discharge channel 71 is positioned to coincide with the corner of recessed cavity 20 defined by adjacent side walls 21 and 22. As depicted in FIGS. 1 and 2, discharge channel 71 may be defined as the area between each end of appendicle seals 61 and 62 and between self-rupturing seal area 50A to the corner edge of container 11. In one embodiment, the distance between each end of appendicle seals 61 and 62 may be between about 2.5 centimeter to about 5.1 centimeter (about 1 inch to about 2 inch), and the distance between self-rupturing seal area 50A and corner edge of container 11 may be between about 1.5 centimeter to about 3.3 (about 0.59 inch to about 1.3 inch). Discharge channel 71 may include a relatively weakly sealed area or be entirely unsealed. In this embodiment, discharge channel 71 may direct the discharge of the contents of the container in a direction generally parallel to the flange 30 and between the ends of appendicle seals 61 and 62.

As illustrated in FIGS. 1 and 2, each depict appendicle seals 61 and 62 spaced apart from inner seal 50 and positioned between inner seal 50 and peripheral edges 11*a* and 11*b*, respectively of container 10. Appendicle seal 61 is positioned generally parallel to inner seal 50 on a plane which is perpendicular to side wall 21. Appendicle seal 62 is also positioned generally parallel to inner seal 50, but on a plane which is perpendicular to side wall 22. Appendicle seals 61 and 62 are each marked in FIGS. 1 and 2 with cross-hatched line segments. As is more clearly illustrated in the close-up view, in FIG. 2, appendicle seals 61 and 62 can be characterized as having a width and a length depended upon the relative dimensions of the recessed cavity 20. In this particular embodiment, appendicle seals 61 and 62 each have an identical width of between about 0.2 centimeter to about 0.5 centimeter (about 0.08 inch to about 0.2 inch) and an identical length of about 2.5 centimeter to about 3.8 centimeter (about 1 inch to about 1.5 inch). Appendicle seals 61 and 62 are preferably separated from inner seal 50 by a distance of between about 0.3 centimeter to about 1.3 centimeter (about 0.1 inch to about 0.5 inch). It will be appreciated that the area separating each appendicle seal from inner seal 50 is an unsealed area.

Figure 3:
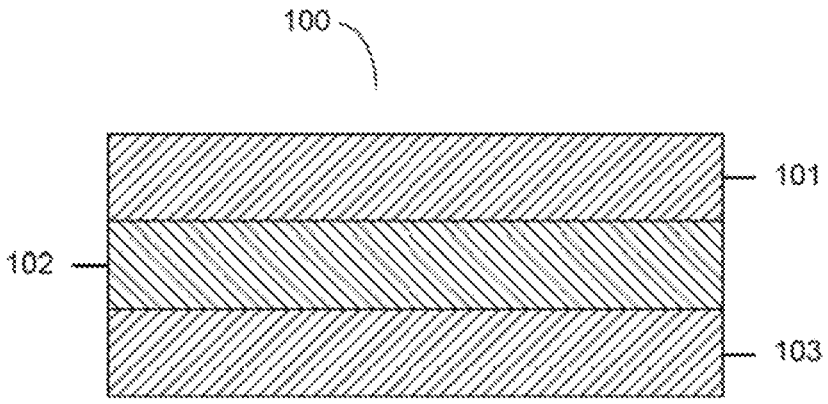
FIG. 3 depicts a cross-sectional view of a general embodiment of a polymeric film structure suitable for use as a recessed cavity with the present invention.

FIG. 3 is a cross-section of an example of a suitable generic rigid or semi-rigid structure 100 that may be used to form the recessed cavity 20 and flange 30 of container 10 of the present invention. As depicted, structure 100 includes a core sub-structure 102 laminated to a first outer sub-structure 101 and a second outer sub-structure 103. Substructures 101, 102 and 103 may each be a monolayer or multilayer polymeric film formed by a coextrusion method Preferably, substructures 101 and 103 are each formed by cast film coextrusion techniques which are well known in the art. Preferably, sub-structure 102 is formed by blown film coextrusion methods which are also well known in the art. Once structure 100 is formed into a flat sheet, it may then undergo a thermoforming process to transform the flat sheet into a shaped container 10 having recessed cavity 20 and flange 30.

Figure 4:
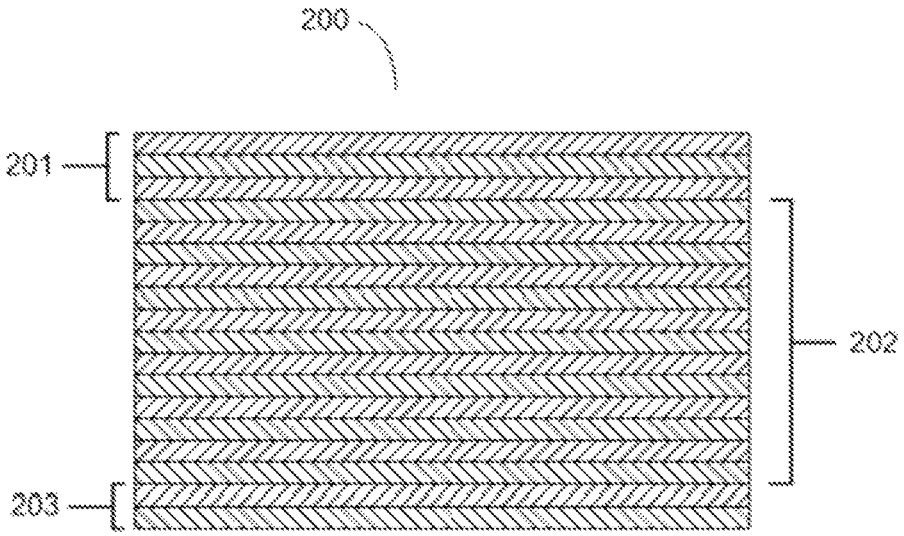
FIG. 4 depicts a cross-sectional view of one embodiment of a polymeric film structure suitable for use as a recessed cavity with the present invention.

FIG. 4 is a cross-section of an example of a particularly suitable multilayer rigid or semi-rigid structure 200 that may be used to form the recessed cavity 20 and flange 30 of container 10 of the present invention. In this embodiment, first outer sub-structure 201 is a 3-layer polymeric film where each of the film layers comprises a polystyrene (PS) and, preferably, high impact polystyrene (HIPS). As depicted, second outer sub-structure 203 is a multilayer polymeric film comprising a first outer film layer of polystyrene (PS) and, preferably, high impact polystyrene (HIPS); an inner film layer comprising anhydride modified polyethylene (mod-PE); and a second outer film layer comprising a blend of polyethylene (PE) and polybutene (PB). The total thickness of first and second outer sub-structures 201 and 203 are each generally from about 127 μm (5 mil) to about 1270 μm (50 mil), typically from about 254 μm (10 mil) to about 1016 μm (40 mil), most typically from about 381 μm (15 mil) to about 635 μm (25 mil).

As further depicted in FIG. 4, sub-structure 202 is a 13-layer blown coextruded polymeric film having the following film layer structure and layer composition: styrene butadiene copolymer (SBC)/high-density polyethylene (HDPE) and maleic anhydride modified polyethylene (mod-PE)/maleic anhydride modified polyethylene (mod-PE)/ethylene vinyl alcohol copolymer (EVOH)/anhydride modified polyethylene (mod-PE)/high-density polyethylene (HDPE)/ethylene vinyl acetate (EVA)/high-density polyethylene (HDPE)/maleic anhydride modified polyethylene (mod-PE)/ethylene vinyl alcohol copolymer (EVOH)/anhydride modified polyethylene (mod-PE)/high-density polyethylene (HDPE)/styrene butadiene copolymer (SBC). The total thickness of sub-structure 202 is generally from about 12.7 μm (0.5 mil) to about 254 μm (10 mil), typically from about 50.8 μm (2 mil) to about 178 μm (7 mil), most typically from about 63 μm (2.5 mil) to about 127 μm (5 mil). In accordance with the present invention, sub-structure 202 may have an oxygen transmission rate of less than 1.0 $cm^3/100\ in^2/24$ h at 73° F. and 0% RH (or 15.5 $cm^3/mil/m^2/24$ h at 23° C. and 0% RH). In another embodiment, sub-structure 202 may have an oxygen transmission rate of less than 0.5 $cm^3/mil/100\ in^2/24$ h at 73° F. and 0% RH (or 7.75 $cm^3/m^2/24$ h at 23° C. and 0% RH).

The above description and the following examples illustrate certain embodiments of the present invention and are not to be interpreted as limiting. Selection of particular embodiments, combinations thereof, modifications, and adaptations of the various embodiments, conditions and parameters normally encountered in the art will be apparent to those skilled in the art and are deemed to be within the spirit and scope of the present invention.

EXAMPLES

Example 1

Example 1 is one embodiment of a container of the present invention having a recessed cavity and flange formed from structure 200 as illustrated in FIG. 4 and a lidding film having the following 8-layer structure and layer compositions:

Layer 1 (outer): 100% (wt.) oriented polyethylene terephthalate (OPET)
Layer 2: 100% (wt.) anchor coating
Layer 3: a blend of about 37% (wt.) low-density polyethylene (LDPE), about 50% (wt.) high-density polyethylene (HDPE) and about 13% (wt.) additives
Layer 4: 100% (wt.) ethylene acrylic acid copolymer (EAA)
Layer 5: 100% (wt.) aluminum foil
Layer 6: 100% (wt.) ethylene acrylic acid copolymer (EAA)
Layer 7: 100% (wt.) linear low-density polyethylene (LLDPE)
Layer 8 (sealant)): a blend of about 77% (wt.) high-density polyethylene (HDPE), about 20% (wt.) polybutene (PB) and about 3% (wt.) additives The sealant layer of the lidding film was heat sealed to the second outer film layer of anhydride modified polyethylene (mod-PE) of second outer sub-structure 203 of structure 200.

Example 2

Example 2 is another embodiment of a container of the present invention having a recessed cavity and flange formed from structure 200 as illustrated in FIG. 4 and a lidding film having the following 12-layer structure and layer compositions:

Layer 1 (outer): 100% (wt.) oriented polyethylene terephthalate (OPET)
Layer 2: 100% (wt.) anchor coating
Layer 3: 100% (wt.) low-density polyethylene (LDPE)
Layer 4: 100% (wt.) ethylene acrylic acid copolymer (EAA)
Layer 5: 100% (wt.) aluminum foil
Layer 6: 100% (wt.) ethylene acrylic acid copolymer (EAA)
Layer 7: 100% (wt.) low-density polyethylene (LDPE)
Layer 8: a blend of about 85% wt.) high-density polyethylene (HDPE), about 14.5% (wt.) low-density polyethylene (LDPE) and about 0.5% (wt.) additives
Layer 9: a blend of about 85% (wt.) high-density polyethylene (HDPE) and about 15% (wt.) low-density polyethylene (LDPE)
Layer 10: 100% (wt.) high-density polyethylene (HDPE)
Layer 11: a blend of about 82% (wt.) low-density polyethylene (LDPE) and about 18% (wt.) polybutene (PB)
Layer 12 (sealant): a blend of about 99.5% (wt.) low density polyethylene (LDPE) and about 0.5% (wt.) additives The sealant layer of the lidding film was heat sealed to the second outer film layer of anhydride modified polyethylene (mod-PE) of second outer sub-structure 203 of structure 200.

Example 3

Example 3 is another embodiment of a container of the present invention having a recessed cavity and flange formed from structure 200 as illustrated in FIG. 4 and a lidding film having the following 8-layer structure and layer compositions:

Layer 1 (outer): 100% (wt.) oriented polyethylene terephthalate (OPET)
Layer 2: 100% (wt.) adhesive
Layer 3: a blend of about 64.1% (wt.) ultra low-density polyethylene (ULDPE), about 35% (wt.) linear low-density polyethylene (LLDPE) and about 0.9 wt.) additives Layer 4: a blend of about 85.9% (wt.) linear low-density polyethylene (LLDPE) and about 14.1% (wt.) maleic anhydride modified polyethylene (mod-PE)

Layer 5: 100% (wt.) ethylene vinyl alcohol copolymer (EVOH)

Layer 6: a blend of about 85.9% (wt.) linear low-density polyethylene (LLDPE) and about 14.1% (wt.) maleic anhydride modified polyethylene (mod-PE)

Layer 7: a blend of about 70% (wt.) ethylene vinyl acetate (EVA) and bout 30% (wt.) polybutene (PB)

Layer 8 (sealant): a blend of about 95% (wt.) ethylene vinyl acetate (EVA) and about 5% (wt.) additives The sealant layer of the lidding film was heat sealed to the second outer film layer of anhydride modified polyethylene (mod-PE) of second outer sub-structure 203 of structure 200.

Example 4

Example 4 is another embodiment of a container of the present invention having a recessed cavity and flange formed from structure 200 as illustrated in FIG. 4 and a lidding film having the following 8-layer structure and layer compositions:

Layer 1 (outer): 100% (wt.) oriented polyethylene terephthalate (OPET)

Layer 2: 100% (wt.) adhesive

Layer 3: a blend of about 64.1% (wt.) ultra low-density polyethylene (ULDPE), about 35% (wt.) linear low-density polyethylene (LLDPE) and about 0.9% (wt.) additives Layer 4: a blend of about 85.9% (wt.) linear law-density polyethylene (LLDPE) and about 14.1% (wt.) anhydride modified polyethylene (mod-PE)

Layer 5: 100% (wt.) ethylene vinyl alcohol copolymer (EVOH)

Layer 6: a blend of about 85.9% (wt.) linear low-density polyethylene (LLDPE) and about 14.1% (wt.) maleic anhydride modified polyethylene (mod-PE)

Layer 7: a blend of about 82% (wt.) ethylene vinyl acetate copolymer (EVA) and about 18% (wt.) polybutene (PB)

Layer 8 (sealant): a blend of about 95% (wt.) ethylene vinyl acetate (EVA) and about 5% (wt.) additives The sealant layer of the lidding film was heat sealed to the second outer film layer of anhydride modified polyethylene (mod-PE) of second outer sub-structure 203 of structure 200.

Example 5

Example 5 is another embodiment of a container of the present invention having a recessed cavity and flange formed from structure 200 as illustrated in FIG. 4 and a lidding film having the following 7-layer structure and layer compositions:

Layer 1 (outer): 100% (wt.) oriented polyethylene terephthalate (OPET)

Layer 2: 100% (wt.) primer

Layer 3: a blend of about 37% (wt.) low-density polyethylene (LDPE), about 50% (wt.) high-density polyethylene (HDPE) and about 13 (wt.) additives Layer 4: 100% (wt.) ethylene acrylic acid copolymer (EAA)

Layer 5: 100% (wt.) aluminum foil

Layer 6: 100% (wt.) ethylene acrylic acid copolymer (EAA)

Layer 7 (sealant): a blend of about 50% (wt.) high-density polyethylene (HDPE), about 30% (wt.) low-density polyethylene (LDPE) and about 20% (wt.) polybutene (PB)

The sealant layer of the lidding film was heat sealed to the second outer film layer of anhydride modified polyethylene (mod-PE) of second outer sub-structure 203 of structure 200.

Example 6

Example 6 is another embodiment of a container of the present invention having a recessed cavity and flange formed from structure 200 as illustrated in FIG. 4 and a lidding film having the following 7-layer structure and layer compositions:

Layer 1 (outer): 100% (wt.) oriented polyethylene terephthalate (OPET)

Layer 2: 100% (wt.) primer

Layer 3: a blend of about 37% (wt.) low-density polyethylene, 50% (wt) high-density polyethylene (HDPE) and about 13% (wt.) additives Layer 4: 100% (wt.) ethylene acrylic acid copolymer (EAA)

Layer 5: 100% (wt.) aluminum foil

Layer 6: 100% (wt.) ethylene acrylic acid copolymer (EAA)

Layer 7 (sealant): a blend of about 44% (wt.) high-density polyethylene (HDPE), about 26.4% (wt.) low-density polyethylene (LDPE) and about 29.6% (wt.) polybutene (PB)

The sealant layer of the lidding film was heat sealed to the second outer film layer of anhydride modified polyethylene (mod-PE) of second outer sub-structure 203 of structure 200.

Example 7

Example 7 is another embodiment of a container of the present invention having a recessed cavity and flange formed from structure 200 as illustrated in FIG. 4 and a lidding film having the following 8-layer structure and layer compositions:

Layer 1 (outer): 100% (wt.) oriented polyethylene terephthalate (OPET)

Layer 2: 100% (wt.) primer

Layer 3: a blend of about 37% (wt.) low-density polyethylene, 50% (wt.) high-density polyethylene (HDPE) and about 13% (wt.) additives Layer 4: 100% (wt.) ethylene acrylic add copolymer (EAA)

Layer 5: 100% (wt.) aluminum foil

Layer 6: 100% (wt.) ethylene acrylic acid copolymer (EAA)

Layer 7: 100% (wt.) linear low-density polyethylene (LLDPE)

Layer 8 (sealant): a blend of about 67% (wt.) high-density polyethylene, about 0% (wt.) polybutene (PB) and about 3% (wt.) additives The sealant layer of the lidding film was heat sealed to the second outer film layer of anhydride modified polyethylene (mod-PE) of second outer sub-structure 203 of structure 200.

Example 8

Example 8 is another embodiment of a container of the present invention having a recessed cavity and flange formed from structure 200 as illustrated in FIG. 4 and a lidding film having the following 4-layer structure and layer compositions:

Layer 1 (outer): 100% (wt.) aluminum foil

Layer 2: a blend of about 50% (wt.) ethylene acrylic acid copolymer and about 50% (wt.) low-density polyethylene Layer 3: 100% (wt.) oriented polyethylene terephthalate (OPET)

Layer 4 (sealant): 100% (wt.) acrylic adhesive

The sealant layer of the lidding film was heat sealed to the second outer film layer of anhydride modified polyethylene (mod-PE) of second outer sub-structure 203 of structure 200.

Burst Pressure: Because the containers of the present invention may be subjected to a pressure during the injection of water, it is desirable that the seals, particularly the self-rupturing inner seal of the container have a burst strength of between about 1 psi to about 15 psi, and preferably between about 2.5 psi to about 15 psi, and more preferably between about 2.5 psi and about 5 psi, The minimum and maximum burst pressure of the rupturing area of the inner seal of Examples 1-5 and Example 8 were measured. Results are shown in Table 1.

TABLE 1

| | Burst Strength | |
|---|---|---|
| | Minimum (psi) | Maximum (psi) |
| Example 1 | 7.6 | 6.3 |
| Example 2 | 4.9 | 5.8 |
| Example 3 | 4.3 | 4.8 |
| Example 4 | 4.3 | 6.2 |
| Example 5 | 10 | 10.5 |
| Example 8 | 4.8 | 4.9 |

The invention claimed is:

1. A rupturable container comprising a product-receiving cavity, a planar flange and a lidding film secured to said flange, and comprising:

a) a self-rupturing continuous inner seal defining a rupturing area;

b) a first appendicle seal;

c) a second appendicle seal;

wherein said appendicle seals extend from said continuous inner seal and terminate at a distal end of said appendicle seals, said distal end being spaced from said inner seal and positioned between said inner seal and a peripheral edge of said container; and d) a discharge channel configured to regulate the direction of discharge of the contents of said container upon rupturing of said inner seal.

2. The rupturable container of claim 1, wherein said flange is rigid or semi-rigid.

3. The rupturable container of claim 1, wherein said product-receiving is circumscribed by said flange and has at least a first side wall and an adjacent second side wall.

4. The container of claim 3, wherein said first appendicle seal is positioned generally parallel to said inner seal on a plane perpendicular to said first side wall.

5. The container of claim 3, wherein said second appendicle seal is positioned generally parallel to said inner seal on a plane perpendicular to the plane of said second side wall.

6. The container of claim 1, wherein said discharge channel is positioned between said distal ends of said first and second appendicle seals.

7. The container of claim 1, wherein said inner seal comprises a self-rupturing area positioned inwardly toward the product-receiving cavity from said first and second appendicle seals.

8. The container of claim 7, wherein said self-rupturing area has an inward protrusion relative to said continuous inner seal.

9. The container of claim wherein said inward protrusion has a chevron shape.

10. The container of claim 1, wherein discharge channel regulates the discharge of the contents of said container in a direction generally parallel to said flange and between the ends of said first and second appendicle seals.

11. The container of claim 1, wherein said discharge channel is substantially unsealed.

12. The container of claim 1, wherein said first and second appendicle seals have substantially identical shapes.

13. The container of claim 1, wherein each of said appendicle seals is spaced from said inner seal by a distance of between about 0.3 centimeter to about 1.3 centimeter (about 0.1 inch to about 0.5 inch).

14. The container of claim 1, wherein said rupturing area ruptures when pressure inside the cavity reaches between 2.5 psi and 15 psi.

15. The container of claim 14, wherein said rupturing area ruptures when pressure inside the cavity reaches between 2.5 psi and 5 psi.

16. The container of claim 1, wherein said inner seal, said first appendicle seal and said second appendicle seal are each heat seals.

17. The container of claim 1, wherein each of said appendicle seals has a width of between about 0.2 centimeter and about 0.5 centimeter (about 0.08 inch to about 0.2 inch).

18. The container of claim 1, wherein each of said appendicle seals has a length of about 2.5 centimeter to about 3.8 centimeter (about 1 inch to about 1.5 inch).

19. The container of claim 1, wherein said inner seal has a width of between about 0.1 centimeter and about 0.5 centimeter (about 0.04 inch to about 0.2 inch).

20. The container of claim 1, wherein said ends of each of said appendicle seals are separated from each other by a distance of between about 2.5 centimeter and about 5.1 centimeter (about 1 inch to about 2 inch).

* * * * *